US008851610B2

(12) United States Patent
Suzuki

(10) Patent No.: US 8,851,610 B2
(45) Date of Patent: Oct. 7, 2014

(54) IMAGE PROCESSING DEVICE

(71) Applicant: Katsuaki Suzuki, Nagoya (JP)

(72) Inventor: Katsuaki Suzuki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/041,234

(22) Filed: Sep. 30, 2013

(65) Prior Publication Data

US 2014/0184684 A1 Jul. 3, 2014

(30) Foreign Application Priority Data

Dec. 28, 2012 (JP) ..... 2012-288706

(51) Int. Cl.
*B41J 2/205* (2006.01)
*B41J 2/21* (2006.01)

(52) U.S. Cl.
CPC ..... *B41J 2/2128* (2013.01)
USPC ..... 347/15; 358/1.2

(58) Field of Classification Search
USPC ..... 347/15, 12, 40, 43
See application file for complete search history.

(56) References Cited

U.S. PATENT DOCUMENTS

| | | | | |
|---|---|---|---|---|
| 6,406,112 | B1 | 6/2002 | Oikawa | |
| 7,104,627 | B2 * | 9/2006 | Weast | 347/19 |
| 7,497,538 | B2 * | 3/2009 | Heydinger | 347/15 |
| 7,914,102 | B2 * | 3/2011 | Imai | 347/19 |
| 8,444,243 | B2 * | 5/2013 | Kakutani | 347/15 |
| 2009/0284559 | A1 | 11/2009 | Sudo et al. | |

FOREIGN PATENT DOCUMENTS

| | | | |
|---|---|---|---|
| JP | H 11-170500 | A | 6/1999 |
| JP | 2009-274280 | A | 11/2009 |

* cited by examiner

*Primary Examiner* — Lamson Nguyen
(74) *Attorney, Agent, or Firm* — Scully, Scott, Murphy & Presser, P.C.

(57) ABSTRACT

A calculator calculates a total value of tone values of all pixels in each aggregation by allocating each pixel of M-valued image data to one aggregation. Each block is either one of ejection-port groups including ejection ports having a common liquid channel serving as a liquid supply source or one of divided ejection-port groups. Each aggregation includes pixels of the M-valued image data corresponding to dots formed on a medium when liquid is ejected from ejection ports in one block during one L ejection period. Each L ejection period is obtained by dividing, by a plural number, a number of ejection cycles required to record an image on one recording medium. A tone-value reducer reduces tone values of at least part of pixels in an adjustment-requiring aggregation so that the total value becomes less than a threshold. A transmitter transmits the adjusted M-valued image data to a liquid ejecting device.

12 Claims, 10 Drawing Sheets

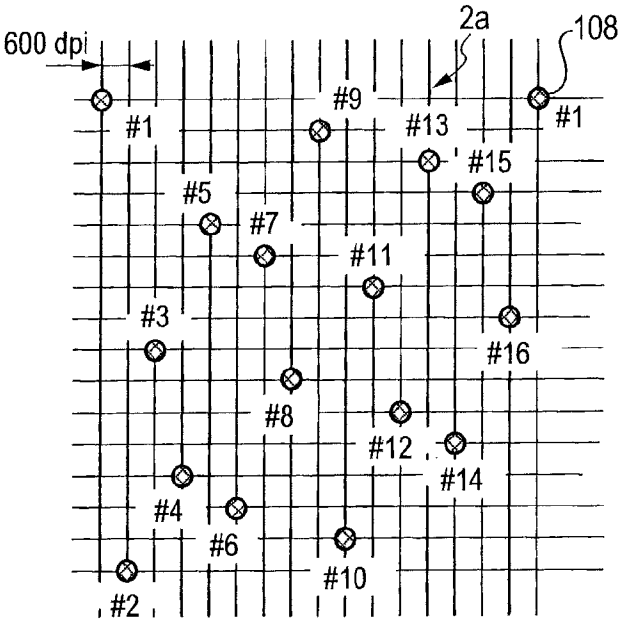
FIG. 5A
FIG. 5B
MULTI-VALUED IMAGE DATA
| PIXEL | #1 | #2 | #3 | #4 | #5 | #6 | #7 | #8 | #9 | #10 | #11 | #12 | #13 | #14 | #15 | #16 | #1 | ... |
|---|---|---|---|---|---|---|---|---|---|---|---|---|---|---|---|---|---|---|
| ... | 16 | 1 | 8 | 4 | 12 | 3 | 11 | 7 | 15 | 2 | 10 | 6 | 14 | 5 | 14 | 9 | 16 | ... |
| ... | 17 | 2 | 9 | 5 | 13 | 4 | 12 | 8 | 16 | 3 | 11 | 7 | 15 | 6 | 15 | 10 | 17 | ... |
| ... | 18 | 3 | 10 | 6 | 14 | 5 | 13 | 9 | 17 | 4 | 12 | 8 | 16 | 7 | 16 | 11 | 18 | ... |
| ... | 19 | 4 | 11 | 7 | 15 | 6 | 14 | 10 | 18 | 5 | 13 | 9 | 17 | 8 | 17 | 12 | 19 | ... |
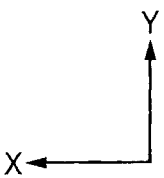

IMAGE PROCESSING DEVICE

CROSS REFERENCE TO RELATED APPLICATIONS

This application claims priority from Japanese Patent Application No. 2012-288706 filed Dec. 28, 2012. The entire content of the priority application is incorporated herein by reference.

TECHNICAL FIELD

The invention relates to an image processing device, a recording apparatus, and a storage medium storing instructions executable on the image processing device.

BACKGROUND

As a liquid ejecting device for recording images by ejecting liquid to a recording medium, there have been known inkjet recording devices provided with recording heads in which a plurality of ejection ports is formed and liquid channels are arranged internally. In such inkjet recording device, the number of tones that can be expressed in an output image is less than that of input image data in general. Therefore, quantization is carried out to reduce tones of input image data to tones that can be expressed by an inkjet recording device in order to record images based on the quantized data. In such inkjet recording devices, liquid channels are refilled (or replenished) with ink supplied from cartridges and the like when ink held in the liquid channels is reduced as a result of ejection from ejection ports.

SUMMARY

In inkjet recording devices of recent years, the amount of ink ejected from a plurality of ejection ports per unit time is increased for enhancement of processing speed. Here, when the amount of ink ejected in one ejection is large, subsequent ejection will start before liquid channels are filled with ink by a refill and, as a result, there may be an under-refilling phenomenon in which the amount of ink becomes insufficient in liquid channels. In particular, at low temperatures, when the flow resistance of ink is increased due to an increase in the viscosity of ink resulting from a temperature decrease or the like, the amount of ink that can be replenished in liquid channels per unit time is reduced and therefore an under-refilling phenomenon is highly likely to occur. Occurrence of the under-refilling phenomenon may prevent normal ink ejection due to a broken meniscus of ink in ejection ports or the like.

In view of the foregoing, the invention provides an image processing device configured to transmit input image data to a liquid ejecting device including a recording head and a drive data generator. The recording head has a plurality of ejection ports for ejecting liquid onto a recording medium and has at least one liquid channel for supplying liquid to respective ones of the plurality of ejection ports. The drive data generator is configured to quantize the input image data to an N-valued data (N is a natural number satisfying N≥2) with a quantization process including a process of reducing a quantization error to generate drive data of the recording head. The image processing device includes a calculator, a tone-value reducer, a transmitter, and a processor. The calculator is configured to calculate a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium. The tone-value reducer is configured to reduce tone values of at least part of the pixels belonging to the aggregation of the pixels of the M-valued image data. The transmitter is configured to transmit the M-valued image data to the drive data generator of the liquid ejecting device, as the input image data. The processor is configured to perform: controlling the calculator to calculate the total value of the tone values of all the pixels belonging to each of the plurality of aggregations; controlling the tone-value reducer to, for an aggregation having the total value greater than or equal to a predetermined threshold, reduce the tone values of at least part of the pixels belonging to the aggregation so that the total value becomes less than the threshold, thereby adjusting the M-valued image data; and controlling the transmitter to transmit the M-valued image data to the drive data generator of the liquid ejecting device, as the input image data.

According to another aspect, the invention also provides a storage medium storing a set of instructions executable on an image processing device configured to transmit input image data to a liquid ejecting device including a recording head and a drive data generator. The recording head has a plurality of ejection ports for ejecting liquid onto a recording medium and has at least one liquid channel for supplying liquid to respective ones of the plurality of ejection ports. The drive data generator is configured to quantize the input image data to an N-valued data (N is a natural number satisfying N≥2) with a quantization process including a process of reducing a quantization error to generate drive data of the recording head. The set of instructions includes: calculating a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium; performing, for each of the plurality of aggregations having the total value greater than or equal to a predetermined threshold, a tone-value reducing process of reducing tone values of at least part of the pixels belonging to the aggregation so that the total value becomes less than the threshold, thereby adjusting the M-valued image data; and transmitting the M-valued image data to the drive data generator of the liquid ejecting device, as the input image data.

According to still another aspect, the invention also provides a recording apparatus including a liquid ejecting device and an image processing device. The liquid ejecting device includes a recording head having a plurality of ejection ports for ejecting liquid onto a recording medium and having at least one liquid channel for supplying liquid to respective ones of the plurality of ejection ports; and a drive data generator configured to quantize the input image data to an N-valued data (N is a natural number satisfying N≥2) with a quantization process including a process of reducing a quantization error to generate drive data of the recording head. The image processing device includes a calculator, a tone-value reducer, a transmitter, and a processor. The calculator is configured to calculate a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium. The tone-value reducer is configured to reduce tone values of at least part of the pixels belonging to the aggregation of the pixels of the M-valued image data. The transmitter is configured to transmit the M-valued image data to the drive data generator of the liquid ejecting device, as the input image data. The processor is configured to perform: controlling the calculator to calculate the total value of the tone values of all the pixels belonging to each of the plurality of aggregations; controlling the tone-value reducer to, for an aggregation having the total value greater than or equal to a predetermined threshold, reduce the tone values of at least part of the pixels belonging to the aggregation so that the total value becomes less than the threshold, thereby adjusting the M-valued image data; and controlling the transmitter to transmit the M-valued image data to the drive data generator of the liquid ejecting device, as the input image data.

According to still another aspect, the invention also provides an image processing device configured to transmit input image data to a liquid ejecting device including a recording head and a drive data generator. The recording head has a plurality of ejection ports for ejecting liquid onto a recording medium and has at least one liquid channel for supplying liquid to respective ones of the plurality of ejection ports. The drive data generator is configured to quantize the input image data to an N-valued data (N is a natural number satisfying N≥2) with a quantization process including a process of reducing a quantization error to generate drive data of the recording head. The image processing device includes a controller configured to: calculate a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium; perform, for an aggregation having the total value greater than or equal to a predetermined threshold, a tone-value reducing process of reducing tone values of at least part of the pixels belonging to the aggregation so that the total value becomes less than the threshold, thereby adjusting the M-valued image data; and transmit the M-valued image data to the drive data generator of the liquid ejecting device, as the input image data.

BRIEF DESCRIPTION OF THE DRAWINGS

Embodiments in accordance with the invention will be described in detail with reference to the following figures wherein:

FIG. 5A is a partial enlarged view of an ejection surface of the recording head;

FIG. 5B shows ejection cycles corresponding to respective pixels of multi-valued image data in the recording head;

DETAILED DESCRIPTION

An inkjet printer including an image processing device and a liquid ejecting device according to an embodiment of the invention will be described below with reference to FIGS. 1 to 9.

Figure 1:
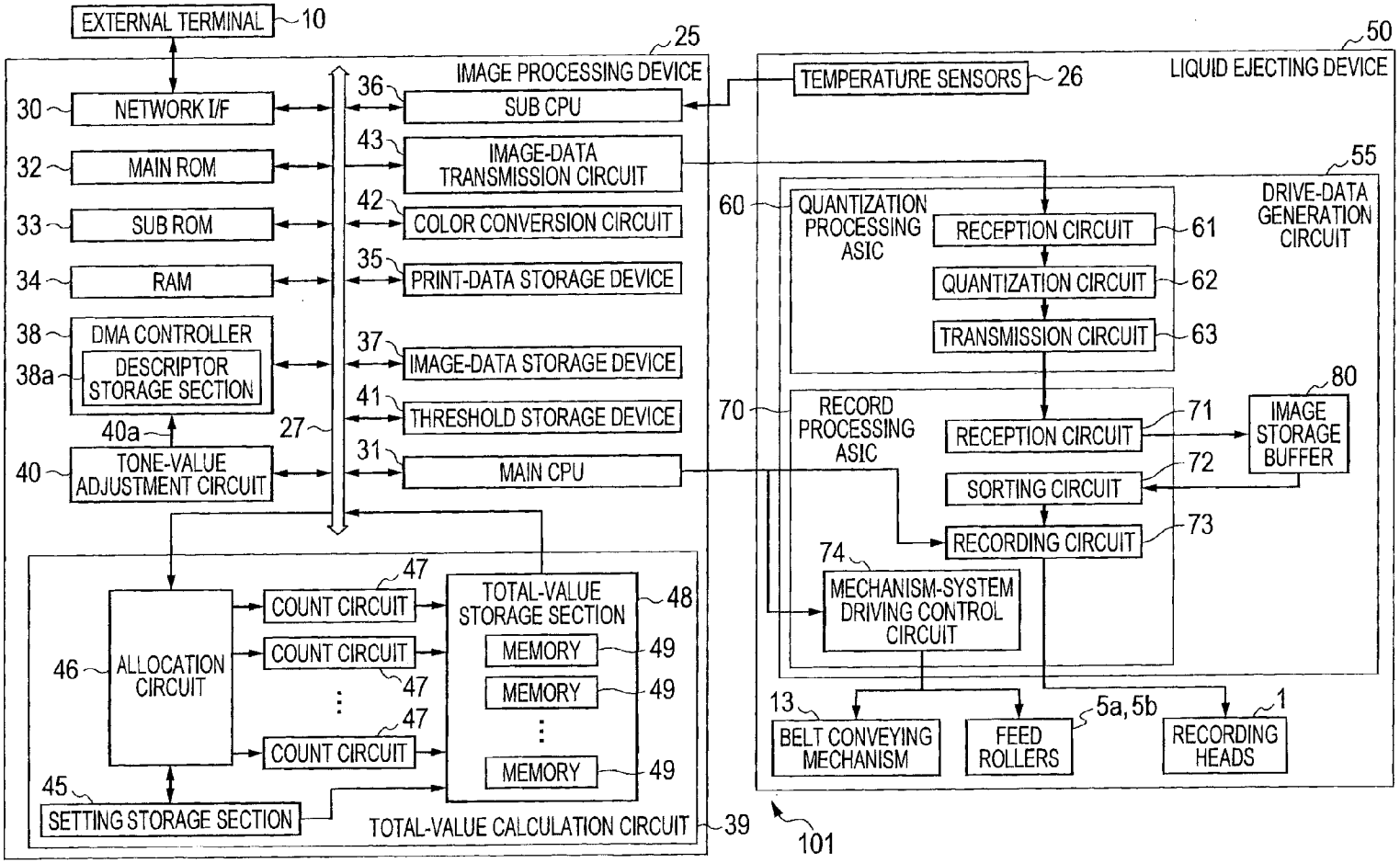
FIG. 1 is a block diagram showing the electric configuration of an inkjet printer according to an embodiment of the invention.

As shown in FIG. 1, an inkjet printer 101 is provided with a liquid ejecting device 50 for recording images on a paper P serving as a recording medium, and an image processing device 25 for transmitting input image data as a recording subject to the liquid ejecting device 50. The image processing device 25 applies known RIP (Raster Image Processor) processing to print data (i.e. data written by PDL (page description language)) received from an external terminal 10 such as a host computer in order to convert the print data into image data with a value of M (M is a natural number satisfying M>N (N is a natural number satisfying N>2); referred to as multi-valued image data hereinafter) in which pixels are arranged in a matrix form corresponding to an image recording area of the paper P. Then, multi-valued image data are transmitted as input image data to the liquid ejecting device 50. Details of the image processing device 25 are described later. Also, multi-valued image data are described below as image data for an image recorded on the paper P of one page.

The liquid ejecting device 50 is a color inkjet recording device having four recording heads 1, each of which ejects ink of a different color selected from four colors (i.e. yellow, magenta, cyan and black) (see FIG. 2), and a drive-data generation circuit 55 for generating drive data for each of the recording heads 1.

Figure 2:
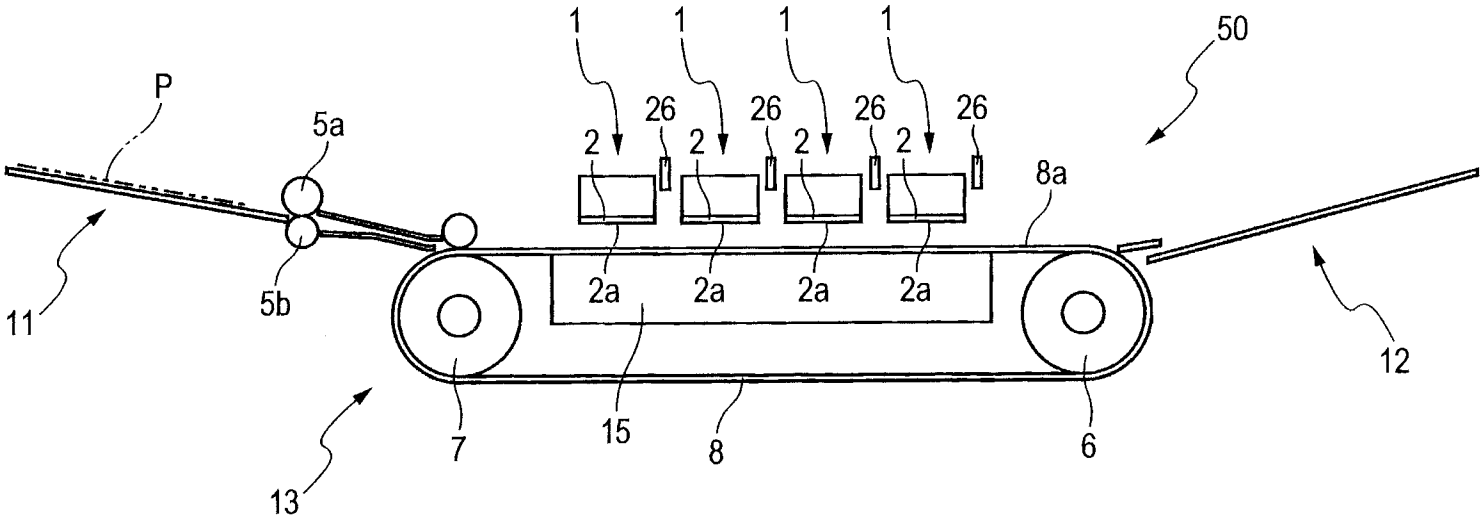
FIG. 2 is a schematic side view of a liquid ejecting device shown in FIG. 1.

As shown in FIG. 2, the liquid ejecting device 50 internally has a conveying path formed to convey the paper P from a paper feed tray 11 to a paper ejection tray 12. Immediately downstream of the paper feed tray 11, a pair of feed rollers 5*a* and 5*b* is placed to hold and convey paper. The pair of feed rollers 5*a* and 5*b* sends out the paper P from the paper feed tray 11 to the right direction in FIG. 2. The paper P sent out by the pair of feed rollers 5*a* and 5*b* is supplied to a belt conveying mechanism 13. The belt conveying mechanism 13 includes two belt rollers 6 and 7, an endless conveying belt 8 wound around both of the rollers 6 and 7 so as to be stretched over therebetween, and a platen 15 placed in a position opposing the four recording heads 1 in an area surrounded by the conveying belt 8. A motor not shown causes the belt roller 6 to rotate clockwise, whereby the conveying belt 8 rotates clockwise. The conveying belt 8 therefore holds and conveys the paper P, which is pressed against an adhesive outer peripheral surface of the conveying belt 8, to the paper ejection tray 12. In the present embodiment, the feed rollers 5*a* and 5*b* and the belt conveying mechanism 13 serve as a conveying means.

The four recording heads 1 are line-type heads arranged along the conveying direction of the paper P and fixed in a position opposing the conveying path. That is, the inkjet printer 101 is a line-type printer. Each of the four recording heads 1 has a head main body 2 in a lower end thereof. Each of the head main bodies 2 is formed into a long rectangular parallelepiped shape in a direction perpendicular to the conveying direction. Bottom surfaces of the head main bodies 2 are used as ejection surfaces 2*a* opposing a conveying surface 8*a* positioned on an upper side of an outer periphery surface of the conveying belt 8. When the paper P conveyed by the conveying belt 8 passes just beneath the four head main bodies 2 sequentially, ink droplets of respective colors are ejected from the ejection surfaces 2*a* toward an upper surface or printed side of the paper P. Therefore, a desired color image is created on the paper P. A temperature sensor 26 is also arranged in each of the four recording heads 1 on a downstream side in the conveying direction. Each of the temperature sensors 26 detects an ambient temperature of the corresponding recording head 1 and outputs a detection result to the image processing device 25.

Figure 3:
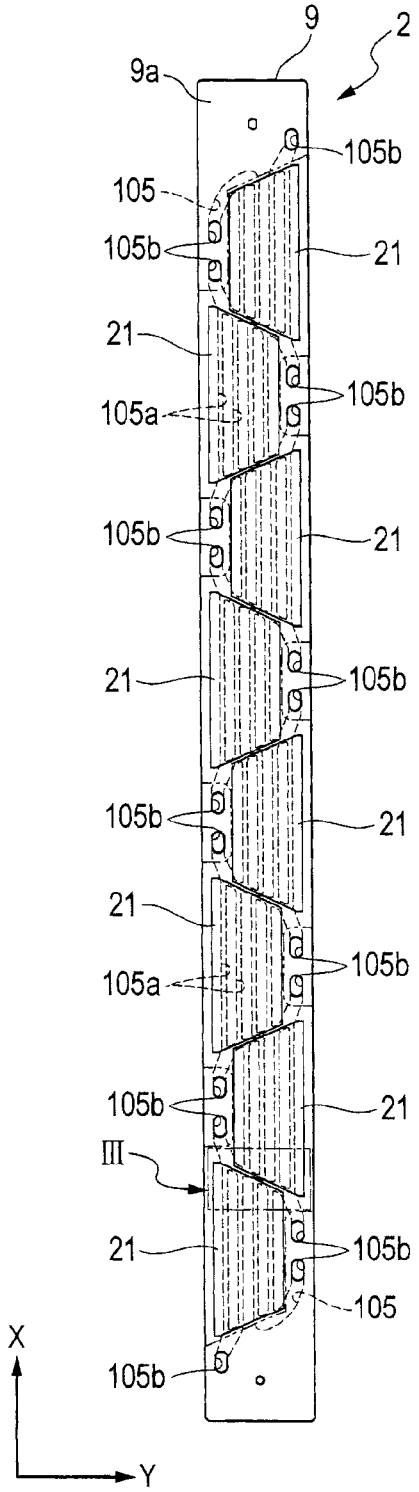
FIG. 3 is a plan view showing a recording head of FIG. 1.
Figure 4A:
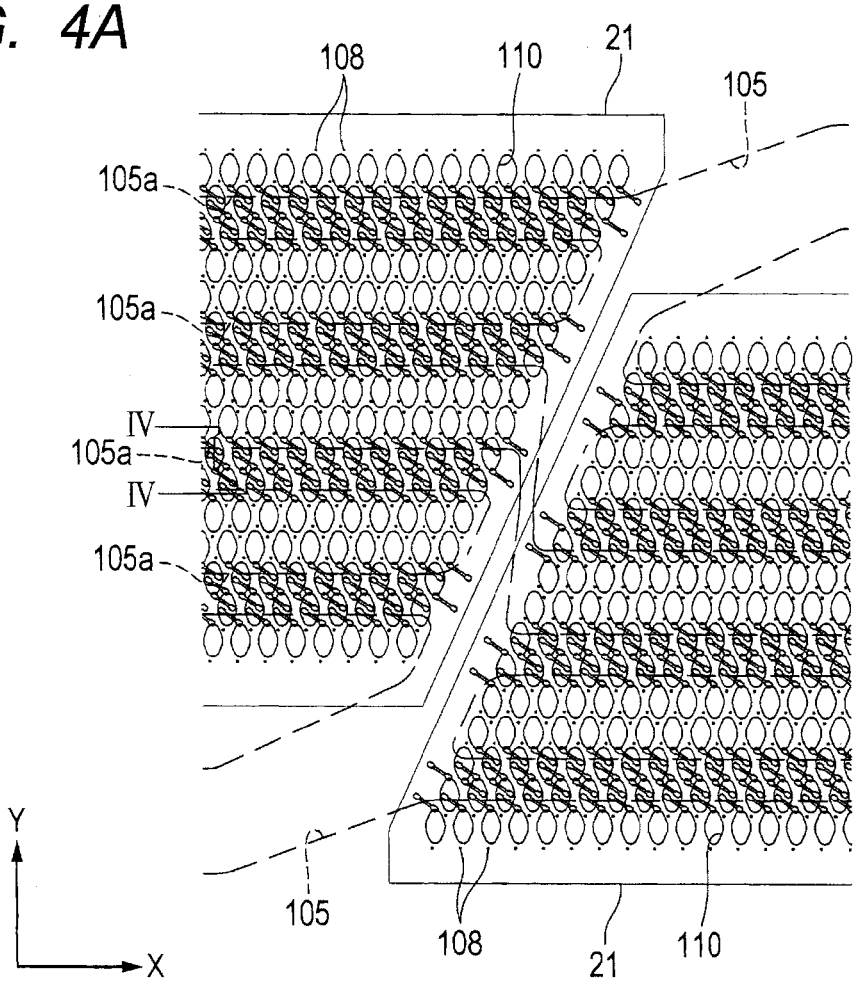
FIG. 4A is an enlarged view showing an area III surrounded by a one-dot chain line in FIG. 3.

Next, the head main bodies 2 of the recording heads 1 are described with reference to FIGS. 3, 4A, and 4B. In FIG. 4A, pressure chambers 110 and ejection ports 108 that are positioned beneath actuator units 21 and should be depicted by a broken line are depicted by a solid line for convenience of illustration. Each of the head main bodies 2 is as shown in FIG. 3, including a channel unit 9, eight actuator units 21 fixed to an upper surface 9*a* of the channel unit 9, and a reservoir unit (not shown). Ink is supplied from a cartridge to the reservoir unit in which a common liquid channel including a reservoir (liquid supply source) for temporarily retaining ink is formed. Each of the actuator units 21 includes a plurality of individual electrodes arranged to oppose a plurality of the pressure chambers 110 formed in the channel unit 9 and has a function to selectively apply ejection energy to ink held in the pressure chambers 110.

Figure 4B:
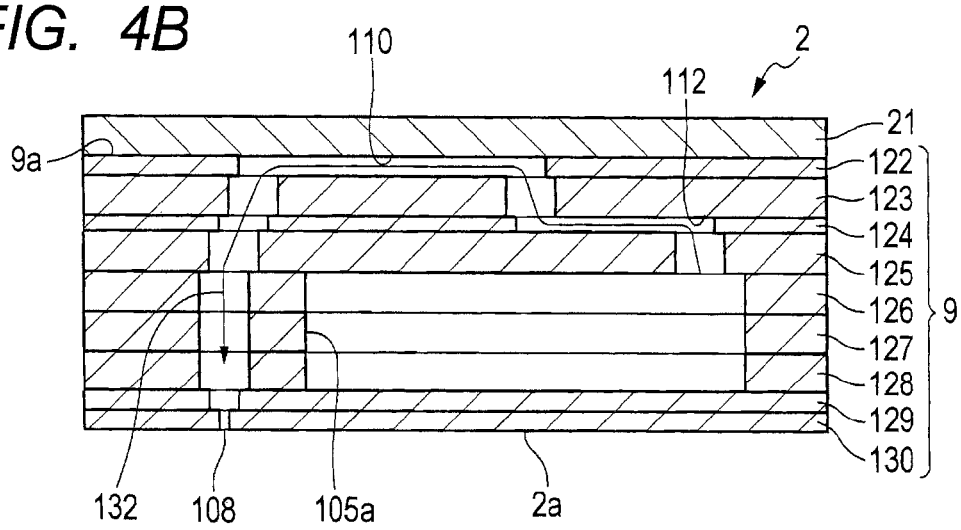
FIG. 4B is a partial cross sectional view along a line IV-IV in FIG. 4A.

Each of the channel units 9 is a layered body formed by layering nine rectangular metal plates 122 to 130 (see FIG. 4B). Ink supply ports 105*b* (FIG. 3) connected to the reservoir unit are opened in the upper surfaces 9*a* of the channel units 9. In the inside of the channel units 9, a plurality of manifold channels 105 with one end connected to the respective ink supply ports 105*b*, a plurality of sub manifold channels 105*a* branched from the respective manifold channels 105, and multiple individual ink channels 132 connected to the respective sub manifold channels 105*a* are formed. Each of the individual ink channels 132 includes an aperture 112 for adjusting channel resistance; starting from an outlet of the sub manifold channel 105*a* and reaches the ejection port 108 via the pressure chamber 110. A plurality of the pressure chambers 110 is arranged in a matrix form in the upper surfaces 9*a* of the channel units 9. Meanwhile, the ejection surfaces 2*a* being lower surfaces of the channel unit 9 have the ejection ports 108 that are arranged in a matrix form or in a two-dimensional and regular manner corresponding to the respective pressure chambers 110.

Next, the actuator units 21 are described. Each of the actuator units 21 includes a plurality of actuators opposing the respective pressure chambers 110. Each of the actuators selectively applies ejection energy to ink held in the pressure chambers 110 according to each ejection cycle (or print cycle). More specifically, the actuator units 21 are composed of three piezoelectric sheets made of lead zirconate titanate (PZT)-based ceramic materials having ferroelectricity. Each of the piezoelectric sheets is a continuous plate with a size covering a plurality of the pressure chambers 110. Individual electrodes are formed in respective positions opposing the pressure chambers 110 on the uppermost piezoelectric sheet. Common electrodes are interposed between the uppermost piezoelectric sheet and the piezoelectric sheet lying underneath the uppermost sheet, throughout entire surfaces of the sheets.

The common electrodes are equally held in the ground potential in an area corresponding to the entire pressure chambers 110. Meanwhile, the individual electrodes selectively receive a signal of which level is converted, by a driver IC (not shown), from a drive signal sent from a recording circuit 73. Thus, portions held between the individual electrodes and the pressure chambers 110 in the actuator units 21 serve as individual actuators. Also, a plurality of actuators as many as the pressure chambers 110 is provided to constitute the actuator units 21.

Here, a method of driving the actuator units 21 is described. The actuator units 21 are so-called unimorph-type actuators in which one piezoelectric sheet placed farthest from the pressure chambers 110 is used as an active layer and the remaining two piezoelectric sheets are used as inactive layers. By outputting a pulse to the individual electrodes, the corresponding piezoelectric sheets are deformed and pressure (or ejection energy) is applied to ink held in the pressure chambers 110, whereby ink droplets are ejected from the ejection ports 108.

Next, arrangement of the ejection ports 108 in the ejection surfaces 2*a* is described with reference to FIG. 5A. In FIG. 5A, the lateral direction corresponds to a main scanning direction X and the vertical direction corresponds to a sub-scanning direction Y. As shown in FIG. 5A, the plurality of ejection ports 108 included in one actuator unit 21 is arranged in the ejection surface 2*a* in a matrix form along the main scanning direction X and the sub-scanning direction Y. More specifically, each of the ejection ports 108 is arranged on any of sixteen virtual lines extending in parallel with each other along the main scanning direction X. That is, the ejection ports 108 in the ejection surfaces 2*a* are arranged such that a plurality of ejection-port arrays consisting of the ejection ports 108 arrayed in the main scanning direction X is arranged in the conveying direction (the sub-scanning direction Y). The ejection ports 108 that are adjacent to each other on the respective virtual lines are also disposed at equal intervals. Then, sixteen ejection ports 108 (hereinafter referred to as ejection ports #1 to #16) arranged on mutually different virtual lines within a width of 600 dpi (about 42 μm)×15 in non-overlapping relationship with each other in the main scanning direction X constitute a basic unit for recording an image at 600 dpi which is the highest resolution in the main scanning direction X. This basic unit is arranged continuously in the main scanning direction X in one actuator unit 21.

All the ejection ports 108 of the eight actuator units 21 in each of the head main bodies 2 (i.e. all the ejection ports 108 in one recording head 1) are arranged with such a positional relationship that all projection points formed by vertically projecting these ejection ports 108 on a virtual line extending in the main scanning direction X are arranged at equal intervals corresponding to the resolution of 600 dpi. Therefore, in an image recorded on the paper P, a dot row formed by a plurality of dots (including non-ejection dots without ejection of ink) disposed along the conveying direction corresponds to one ejection port 108. An image recorded on the paper P includes a plurality of such dot rows formed at equal intervals of about 42 μm.

Furthermore, two ejection ports 108 adjacent to one ejection port 108 in the longitudinal direction of the recording head 1, that is, the main scanning direction X (e.g. two ejection ports #7 and #9 adjacent to the ejection port #8) are arranged either above or below the ejection port 108 in the sub-scanning direction Y. This relationship is applicable to any of the ejection ports 108. That is, the plurality of ejection ports 108 is arranged in a zigzag form along the main scanning direction X. Therefore, the individual ink channels including the ejection ports 108 can be arranged with high density in the channel units 9. Note that the following explanation is based on the assumption that the sixteen virtual lines are arranged at equal intervals of 600 dpi (about 42 μm) in order to simplify explanation.

Here, as described above, because the plurality of ejection ports 108 is arranged in a matrix form within the actuator units 21 of the head bodies 2, dots formed on the paper P by ejecting ink from the recording head 1 in one ejection cycle are not adjacent to each other. Here, the ejection cycle refers to a period of time required to convey the paper P by the belt conveying mechanism 13 by a unit distance corresponding to a print resolution in the sub-scanning direction Y. Accordingly, dots formed on the paper P corresponding to adjacent pixels in multi-valued image data created in the image processing device 25 are not formed in the same ejection cycle. For example, as shown in FIG. 5B, when attention is paid to the ejection ports 108 arranged within one actuator unit 21, regarding a plurality of pixels (or pixels of one raster) of multi-valued image data disposed along the main scanning direction X, a dot corresponding to a pixel allocated to the ejection port #1 is formed fifteen ejection cycles after formation of a dot corresponding to a pixel allocated to the ejection port #2. Note that numbers of respective pixels of multi-valued image data shown in FIG. 5B indicate in which ejection cycle of the recording head 1 the dots corresponding to the pixels are formed on the paper P.

Referring back to FIG. 1, the drive-data generation circuit 55 is described. The drive-data generation circuit 55 includes a quantization process ASIC (Application Specific Integrated circuit) 60, an image storage buffer 80, and a record processing ASIC 70. The quantization processing ASIC 60 performs a quantization process including a process of reducing quantization errors for multi-valued image data received from the image processing device 25. The image storage buffer 80 temporarily stores image data subjected to the quantization process by the quantization processing ASIC 60. The record processing ASIC 70 performs a recording process of recording images on the paper P based on image data stored in the image storage buffer 80.

The quantization processing ASIC 60 includes a reception circuit 61, a quantization circuit 62, and a transmission circuit 63. The reception circuit 61 receives multi-valued image data (or input image data) transmitted from the image processing device 25. The quantization circuit 62 performs a quantization process of converting multi-valued image data received by the reception circuit 61 into N-valued low-tone image data for ejection (N is a natural number satisfying $M>N\geq 2$; hereinafter referred to as low-tone image data). For example, if the recording head 1 is capable of recording images of two tones that are "zero or droplet", a binary quantization process is carried out. If the recording head 1 is capable of recording images of four tones that are "zero, small droplet, medium droplet, or large droplet", a quaternary quantization process is carried out. The transmission circuit 63 transmits low-tone image data converted by the quantization circuit 62 to the record processing ASIC 70. Descriptions are provided below on the assumption that multi-valued image data has 256 tones and the recording head 1 is capable of recording images in four tones.

Here, the quantization process performed by the quantization circuit 62 includes a process of reducing a quantization error. In the present embodiment, an error diffusion process is carried out to reduce a quantization error. The error diffusion process is a processing method in which, for each pixel of multi-valued image data, a tone value (or input density value) of 256 tones of the subject pixel is converted into a tone value (output density value) of 4 tones and an error value obtained by subtracting a relative density value corresponding to the output value from the input density value is reflected on unprocessed surrounding pixels. Therefore, when error diffusion is performed, unique pixels having different tone values from those obtained by simply quantizing multi-valued image data will appear.

The record processing ASIC 70 includes a reception circuit 71, a sorting circuit 72, the recording circuit 73, and a mechanism-system driving control circuit 74. The reception circuit 71 receives low-tone image data from the quantization processing ASIC 60 to store the data in the image storage buffer 80. The sorting circuit 72 sorts out low-tone image data stored in the image storage buffer 80 in a form corresponding to an arrangement pattern of the ejection ports 108 in the recording head 1 in order to create drive data for the recording head 1. The recording circuit 73 sends out drive data and an ejection waveform signal to the recording head 1 according to each ejection cycle, based on a control signal sent from a main CPU 31 of the image processing device 25 to be described later. The mechanism-system driving control circuit 74 controls the belt conveying mechanism 13 and the feed rollers 5*a* and 5*b* based on the control signal sent from the main CPU 31. That is, an image of drive data created by the sorting circuit 72 is recorded on the paper P by the recording heads 1, the belt conveying mechanism 13, and the feed rollers 5*a* and 5*b*.

Next, the image processing circuit 25 is described in detail. The image processing circuit 25 has a network interface 30, the main CPU (Central Processing Unit) 31, a main ROM (Read Only Memory) 32, a sub ROM 33, a RAM (Random Access Memory) 34, a print-data storage device 35, a sub CPU 36, an image data storage device 37, a DMA (Direct Memory Access) controller 38, a total-value calculation circuit 39, a tone-value adjustment circuit 40, a threshold storage device 41, a color conversion circuit 42, an image-data transmission circuit 43, and a bus 27 for allowing these components to communicate with each other.

The network interface 30 is connected to the external terminal 10 via LAN and the like. The main CPU 31 controls the entire operation of the inkjet printer 101. The main ROM 32 stores various kinds of programs executed by the main CPU 31. The sub ROM 33 stores various kinds of control programs executed by the sub CPU 36 and a plurality of ejection-port information (to be described later) corresponding to properties of multi-valued image data such as resolution and size. The RAM 34 is used as a work area for the main CPU 31 and the sub CPU 36. The print-data storage device 35 stores print data (PDL data) received from the external terminal 10 via the network interface 30.

The sub CPU 36 performs an image process of creating multi-valued image data by using print data stored in the print-data storage device 35 according to a processing instruction sent from the main CPU 31. More specifically, the sub CPU 36 converts print data stored in the print-data storage device 35 into multi-valued image data of the RGB color system by RIP processing. The sub CPU 36 also instructs the DMA controller 38 to transfer multi-valued image data of the RGB color system to the color conversion circuit 42. The color conversion circuit 42 uses the multi-valued image data of the RGB color system to create four multi-valued image data of the CMYK color system corresponding to black, cyan, magenta and yellow. Note that multi-valued image data of the CMYK color system have color tone values for respective pixels arranged in a matrix form corresponding to an image recording area of the paper P. The image-data storage device 37 stores the multi-valued image data converted into the CMYK color system. Descriptions are provided below by paying attention to a process for one multi-valued image data out of the four multi-valued image data of the CMYK color system.

The DMA controller 38 performs a transfer process of transferring multi-valued image data in accordance with instructions sent from the sub CPU 36 and the tone-value adjustment circuit 40. Note that the DMA controller 38 has a descriptor storage section 38*a* for storing descriptors included in the instructions sent from the sub CPU 36 and the tone-value adjustment circuit 40. The descriptor includes information required for the transfer process, such as transfer-source address information (e.g. initial address of a transfer source; ending address of the transfer source, etc.) of a storage area in which transfer data of transfer source devices are stored, and transfer-destination address information of a storage area in which transfer data of transfer destination devices are stored. The DMA controller 38 executes the transfer process by reading descriptors stored in the descriptor storage section 38*a*. When the transfer process is finished, the DMA controller 38 also transmits transfer-end information, which indicates that the transfer process is finished, to the sub CPU 36 and the tone-value adjustment circuit 40 from which instructions are received. In the present embodiment, the DMA controller 38 performs the transfer process of multi-valued image data to/from each of the image-data storage device 37, the sub CPU 36, the total-value calculation circuit 39, the tone-value adjustment circuit 40, the color conversion circuit 42, and the reception circuit 71 of the quantization processing ASIC 60.

When a large amount of ink is ejected in one ejection from the plurality of ejection ports 108 that share a common liquid channel serving as an ink supply source (i.e. the reservoir in the present embodiment), subsequent ejection starts before the liquid channel is filled with ink by a refill. As a result, an under-refilling phenomenon is likely to occur, wherein the amount of ink becomes insufficient in the liquid channel. Therefore, for prevention of occurrence of the under-refilling phenomenon, it is considered to reduce tone values of drive data (i.e. low-tone image data) created by the drive-data generation circuit 55 of the liquid ejecting device 50. However, in this case, if tone values of unique pixels generated in error diffusion are reduced, the quality of images recorded on the paper P will deteriorate as a result.

Therefore, in the present embodiment, if an under-refilling phenomenon is likely to occur, tone values of multi-valued image data are reduced prior to transmission to the drive-data generation circuit 55 (or prior to the quantization process), instead of reducing tone values of drive data created by the drive-data generation circuit 55. By reducing tone values of multi-valued image data prior to the quantization process by the drive-data generation circuit 55 as described above, it is possible to avoid reduction of tone values of unique pixels generated to reduce a quantization error in the quantization process. As a result, in comparison with the case of reducing tone values of drive data created by the drive-data generation circuit 55, quality deterioration of images recorded on the paper P can be suppressed. This process of preventing occurrence of an under-refilling phenomenon and to adjust multi-valued image data is carried out by the sub CPU 36, the DMA controller 38 (as transmission means), the total-value calculation circuit 39 (as total value calculation means), and the tone-value adjustment circuit 40 (as tone value adjustment means). More details are described below.

When multi-valued image data converted by the color conversion circuit 42 are transferred to the image-data storage device 37, the sub CPU 36 also instructs the DMA controller 38 to transfer multi-valued image data to the total-value calculation circuit 39. Note that the DMA controller 38 transfers multi-valued image data for one raster, at a time, that is a pixel row of image data along the main scanning direction X.

Here, in the present embodiment, an aggregation of the ejection ports 108 belonging to each of the eight actuator units 21 in the head main body 2 of the recording head 1 is defined as one block. That is, there are eight blocks in one recording head 1. Also, ejection periods corresponding to the number of divided ejection cycles obtained by dividing the number of ejection cycles required for recording an image of multi-valued image data on one paper P into a plural groups are referred to as L ejection periods (L is a natural number satisfying $L \geq 1$; hereinafter referred to aggregation ejection periods). Descriptions are provided below for aggregation ejection periods that are applied when an image of multi-valued image data is recorded on one paper P of DIN A4 size with a resolution of 600 dpi in the sub-scanning direction Y. When the resolution is 600 dpi in the sub-scanning direction Y, the number of dots formed on the paper P of A4 size in the sub-scanning direction Y by ink ejected from the ejection ports 108 is 6814. The plurality of ejection ports 108 is also arranged in a matrix form within the respective actuator units 21 of the head main bodies 2 as described above. Regarding the ejection port #1 and the ejection port #2 that are positioned farthest from each other in the sub-scanning direction Y, a dot corresponding to a pixel allocated to the ejection port #1 is formed 15 ejection cycles after formation of a dot corresponding to a pixel allocated to the ejection port #2. Accordingly, the number of entire ejection cycles required to record an image on one paper P of A4 size is 6829 (=6814+15). And, when the entire ejection cycles are divided by 16, respective divided ejection cycles are 426 (with one exception in which divided ejection cycles are 439), so that the number of ejection cycles in each aggregation ejection period is set to 426 (with one exception in which the number of ejection cycles in one aggregation ejection period is 439). The following explanation is based on the assumption that the number of ejection cycles in each aggregation ejection period is 426 corresponding to respective divided ejection cycles obtained by dividing the entire ejection cycles of 6816 by 16 in order to simplify explanation.

Also, depending on properties of multi-valued image data such as resolution and size, there may be ejection ports 108 that do not eject ink during image recording to record an image. That is, there may be ejection ports 108 to which pixels of multi-valued image data are not allocated. Therefore, the sub CPU 36 selects one of a plurality of ejection-port information stored in the sub ROM 33 according to properties of multi-valued image data such as resolution and size that are transferred to the total-value calculation circuit 39, and transmits the ejection-port information to the total-value calculation circuit 39. Here, the ejection-port information includes information indicating to which of 8 blocks each pixel of multi-valued image data is to be allocated, information indicating to which of the ejection ports 108 #1 to #16 each pixel of multi-valued image data is to be allocated, and information indicating to which of a plurality of aggregations (to be described later) each pixel of multi-valued image data is to be allocated.

Figure 6:
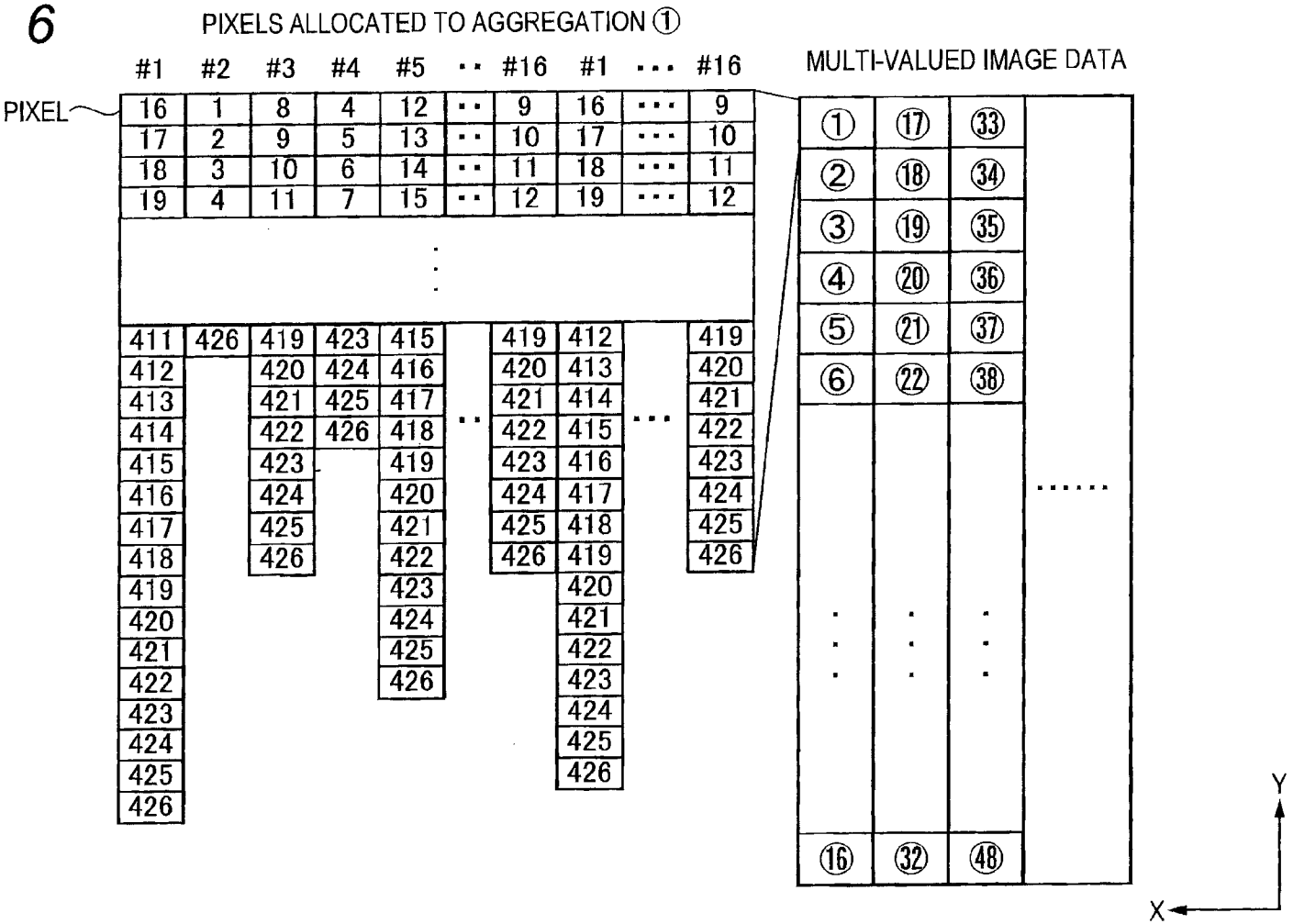
FIG. 6 is an explanatory diagram for illustrating an aggregation to which respective pixels of multi-valued pixel data are allocated.

As shown in FIG. 6, the total-value calculation circuit 39 allocates each pixel of multi-valued image data to one of a plurality of aggregations during one aggregation ejection period in accordance with ejection-port information received from the sub CPU 36, wherein an aggregation of pixels of multi-valued image data corresponding to dots that are ejected from the respective ejection ports 108 belonging to one block and formed on the paper P is treated as one aggregation. Here, circled numbers in FIG. 6 refer to aggregation numbers to which respective pixels of multi-valued image data are allocated. Note that, in the present embodiment, there are eight blocks, and each aggregation ejection period corresponds to divided ejection cycles obtained by dividing the entire ejection cycles by 16, which means there are 128 aggregations. Thereafter, the total-value calculation circuit 39 calculates, for each aggregation, a total value of tone values of all the pixels belonging to each aggregation (hereinafter referred to as total tone value).

Next, the sub CPU 36 determines whether a plurality of aggregations of multi-valued image data includes an aggregation of which the total tone value calculated by the total-value calculation circuit 39 is greater than or equal to a predetermined threshold (hereinafter referred to as adjustment-requiring aggregation). If it is determined that an adjustment-requiring aggregation exists, the sub CPU 36 determines to reduce tone values of at least part of pixels belonging to the adjustment-requiring aggregation. Here, the above threshold is adjusted by the sub CPU 36 based on detection results of the ambient temperature of the recording head 1 to be sent from the temperature sensor 26 and temperature-threshold-relation information stored in the threshold storage device 41. The temperature-threshold-relation information indicates a relationship between the ambient temperature of the recording head 1 and a threshold for the total tone value of the aggregation. Meanwhile, as the ambient temperature decreases in the recording head 1, the flow resistance of ink increases due to increased ink viscosity or the like, wherein an under-refilling phenomenon is likely to occur. Therefore, the threshold storage device 41 stores the temperature-threshold-relation information in which a threshold is set to be smaller as the ambient temperature of the recording head 1 decreases. Therefore, even if the ambient temperature is low in the recording head 1, an under-refilling phenomenon can be certainly prevented. In the present embodiment, the sub CPU 36 serves as threshold adjustment means.

When the sub CPU 36 determines to reduce tone values of at least part of pixels belonging to an adjustment-requiring aggregation, the sub CPU 36 instructs the tone-value adjustment circuit 40 to start adjustment so that a tone-value reducing process is performed to reduce tone values of pixels belonging to the adjustment-requiring aggregation, out of pixels of multi-valued image data stored in the image-data storage device 37. The sub CPU 36 also determines, for each adjustment-requiring aggregation, a first limit function and a second limit function corresponding to the adjustment-requiring aggregation based on the difference between the total value of tone values of pixels belonging to the adjustment-requiring aggregation and the threshold, and sends these limit functions to the tone-value adjustment circuit 40. Specifically, a plurality of patterns for each of the first and second limit functions is preliminarily stored in the main ROM 32 or the sub ROM 33, for example, and the sub CPU 36 selects the suitable first and second limit functions from among the plurality of patterns based on the difference between the total value of tone values and the threshold, as described above. Here, the first limit function and the second limit function are used for setting, for each pixel, a limit multiplier to be multiplied to a tone value of each pixel belonging to the adjustment-requiring aggregation and established so that the total tone value of tone values of pixels belonging to the adjustment-requiring aggregation becomes less than the threshold. The first limit function indicates a first variable determined according to a position of each pixel belonging to the adjustment-requiring aggregation in the sub-scanning direction Y, and the second limit function indicates a second variable determined according to a position of each pixel belonging to the adjustment-requiring aggregation in the main scanning direction X. The limit multiplier for each pixel belonging to the adjustment-requiring aggregation is set to a value obtained by multiplying the first variable and the second variable. Accordingly, for example, if the first variable determined by the first function is 0.9 and the second variable determined by the second limit function is 0.95, the limit multiplier is set to 0.855 (=0.9×0.95).

The first limit function and the second limit function are also set so that a reduction amount of reducing the total tone value of tone values of pixels belonging to the adjustment-requiring aggregation increases as a difference between the total tone value and the threshold increases.

Figure 7:
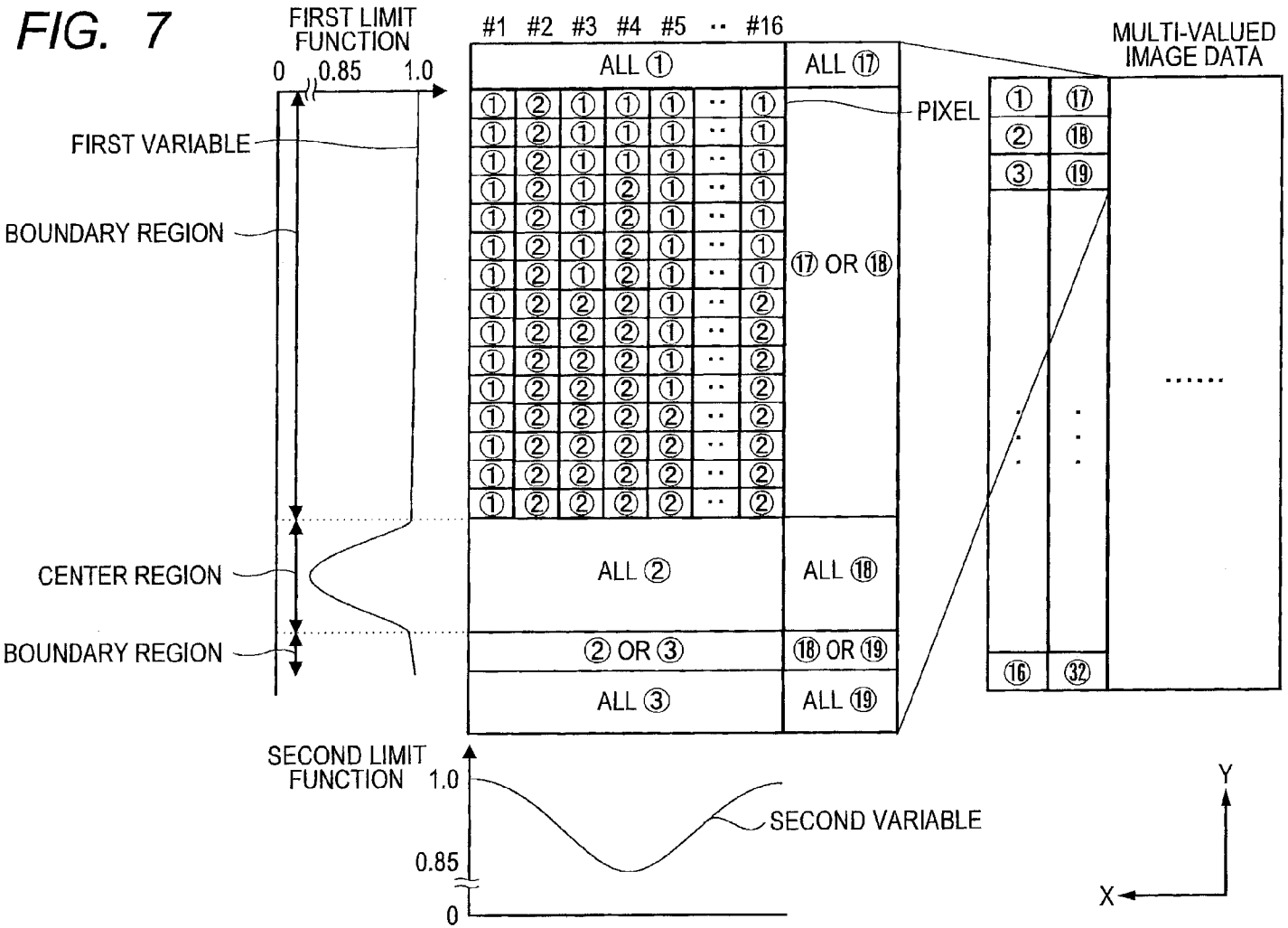
FIG. 7 is an explanatory diagram for illustrating a tone-value reducing process of reducing tone values of pixels of multi-valued pixel data.

Specific descriptions are provided below for the first limit function and the second limit function with reference to FIG. 7. In FIG. 7, circled numbers in respective pixels of multi-valued image data indicate aggregation numbers to which respective pixels are allocated, and circled number 2 corresponds to an adjustment-requiring aggregation. In the present embodiment, as shown in FIG. 7, the first limit function and the second limit function are provided with the first valuable and the second variable falling in a range of 0.85 to 1.0 respectively and established so that a reduction amount for reducing tone values is smaller for pixels disposed closer to boundaries to adjacent aggregations in the sub-scanning direction Y and the main scanning direction X. More specifically, in the first limit function, when pixels belonging to the adjustment-requiring aggregation are divided into three groups in the sub-scanning direction Y, the first variable is set to about 1.0 in two boundary regions on the upper and lower sides and to approach 0.85 toward the center of a center region in the sub-scanning direction Y. Here, the boundary region refers to an area in which the number of pixels disposed in the same position in the sub-scanning direction Y out of pixels belonging to the adjustment-requiring aggregation is less than the number of the ejection ports 108 belonging to a block corresponding to the adjustment-requiring aggregation. The center region refers to a region in which the number of pixels disposed in the same position in the sub-scanning direction Y out of pixels belonging to the adjustment-requiring aggregation is the same as the number of the ejection ports 108 belonging to the block corresponding to the adjustment-requiring aggregation. In the second limit function, the second variable is also set to about 1.0 in both ends in the main scanning direction X and to approach 0.85 toward the center in the main scanning direction X.

When an instruction to start adjustment is received from the sub CPU 36, the tone-value adjustment circuit 40 instructs the DMA controller 38 to transfer, to the tone-value adjustment circuit 40, all the pixels belonging to adjustment-requiring aggregations in multi-valued image data stored in the image-data storage device 37. The tone-value adjustment circuit 40 also performs the tone-value reducing process for reducing tone values of pixels belonging to adjustment-requiring aggregations according to the first limit function and the second limit function received from the sub CPU 36. Because the first limit function is set such that a reduction amount for reducing tone values is smaller for pixels disposed closer to boundaries to adjacent aggregations in the sub-scanning direction Y as described above, images can be formed smoothly on the paper P in the sub-scanning direction Y. At the same time, because the second limit function is set such that a reduction amount for reducing tone values is smaller for pixels disposed closer to boundaries to adjacent aggregations in the main scanning direction X, images can also be formed smoothly on the paper P in the main scanning direction X.

The tone-value adjustment circuit 40 sequentially reduces pixels belonging to adjustment-requiring aggregations in the tone-value reducing process, and instructs the DMA controller 38 to sequentially transfer, to the image-data storage device 37, pixels of which tone values have been reduced. Note that the tone-value adjustment circuit 40 processes pixels in the order of aggregations rather than the order of raster data in the tone-value reducing process, but pixels are sorted out in the order of raster data and transferred to the image-data storage device 37. Therefore, pixels belonging to aggregations that are greater than or equal to the threshold in multi-valued image data stored in the image-data storage device 37 are replaced sequentially with pixels of which tone values have been reduced by the tone-value adjustment circuit 40. In addition, the tone-value adjustment circuit 40 directly writes address information in output descriptors described later, via a signal line 40*a*. The output descriptors are stored in the descriptor storage section 38*a* of the DMA controller 38 and used for a transfer process from the image-data storage device 37 to the drive-data generation circuit 55. The address information indicates address positions of pixels of which tone values have been reduced in a storage area of the image-data storage device 37.

The sub CPU 36 also instructs the DMA controller 38 to output data so that at least part of pixels of multi-valued image data stored in the image-data storage device 37 is transferred to the drive-data generation circuit 55 of the liquid ejecting device 50 via the image-data transmission circuit 43, after the sub CPU 36 instructs the tone-value adjustment circuit 40 to start adjustment and before the tone-value adjustment circuit 40 finishes the tone-value reducing process. Thus, the transfer process of transferring multi-valued image data from the image processing device 25 to the liquid ejecting device 50 and the tone-value reducing process of the multi-valued image data are executed in parallel. Note that the output instruction includes a descriptor (hereinafter referred to as output descriptor) containing information of an address in which multi-valued image data are stored in the image-data storage device 37, information of addresses of pixels that do not belong to an adjustment-requiring aggregation, and information of addresses of pixels that belong to adjustment-requiring aggregations. The output descriptor stored in the descriptor storage section 38*a* also stores information indicating address positions of pixels of which tone values have been reduced in multi-valued image data stored in the image-data storage device 37 in accordance with an instruction sent from the tone-value adjustment circuit 40, as described above.

The DMA controller 38 reads the output descriptor stored in the descriptor storage section 38*a*. And, if a raster not transferred to the drive-data generation circuit 55 and located at the most leading-end side of the paper is an adjusted raster, out of rasters of multi-valued image data stored in the image-data storage device 37, the DMA controller 38 sequentially transfers the adjusted raster to the drive-data generation circuit 55 via the image-data transmission circuit 43. Here, the adjusted raster refers to a raster satisfying a condition that respective pixels included in the raster are either pixels that do not belong to an adjustment-requiring aggregation or pixels that belong to an adjustment-requiring aggregation but have been adjusted by the tone-value adjustment circuit 40.

Next, the total-value calculation circuit 39 is described in detail. The total-value calculation circuit 39 includes a setting storage section 45, an allocation circuit 46, sixteen count circuits 47 corresponding to #1 to #16 of the ejection ports 108 respectively, and a total-value storage section 48 having a plurality of memories 49 corresponding to a plurality of aggregations of multi-valued image data. The setting storage section 45 stores ejection-port information received from the sub CPU 36. The setting storage section 45 also stores storage-destination memory information indicating the memories 49 of storage destinations for storing count values described later that are outputted from the respective sixteen count circuits 47.

When a raster of multi-valued image data is received from the sub CPU 36, the allocation circuit 46 treats a pixel disposed at one end of the raster as a subject pixel and determines to which one of the ejection ports 108 #1 to #16 the subject pixel is allocated, by referring to the ejection-port information stored in the setting storage section 45. Then, based on the determination result, the allocation circuit 46 transmits the tone value of the subject pixel to the count circuit 47 corresponding to the same ejection port 108. Thereafter, the subject pixel is shifted to an adjacent pixel in the raster and a similar process is repeated for all the pixels included in the raster. In addition, when the allocation circuit 46 transmits the tone value of the subject pixel to the corresponding count circuit 47, the allocation circuit 46 refers to the ejection-port information stored in the setting storage section 45 and, if a block to which the subject pixel belongs is different from a block of the previous subject pixel for which a tone value is transmitted to the count circuit 47, the allocation circuit 46 transmits an output instructing command for instructing the total-value storage section 48 to output a count value before transmitting the subject pixel to the count circuit 47. The allocation circuit 46 also transmits an output instructing command to all the count circuits 47 when a pixel disposed to the other end of the raster is transmitted to the corresponding count circuit 47 as the subject pixel.

In transmitting a tone value of a subject pixel to the corresponding count circuit 47, the allocation circuit 46 refers to the ejection-port information stored in the setting storage section 45. If an aggregation to which the subject pixel is allocated is different from an aggregation to which a subject pixel transmitted immediately before the count circuit 47 of a transmission destination has been allocated, the storage-destination memory information stored in the setting storage section 45 is rewritten so that the memory 49 for storage is the memory 49 corresponding to the aggregation to which the subject pixel is allocated.

Each of the count circuits 47 stores a count value that is increased by a tone value of a subject pixel whenever the subject pixel is received from the allocation circuit 46. Each of the count circuits 47 also outputs a count value to the total-value storage section 48 and initializes the count value to zero, when the output instructing command is received from the allocation circuit 46.

The total-value storage section 48 stores count values received from each of the sixteen count circuits 47 by adding the count value to the total tone value stored in one of the plurality of memories 49 based on the storage-destination memory information stored in the setting storage section 45. Note that the total-value storage section 48 initializes total tone values stored in each memory 49 when the total-value storage section 48 receives the ejection-port information from the sub CPU 36. With the above-described configuration, each memory 49 provided in the total-value storage section 48 stores the total tone values of tone values of all the pixels belonging to a corresponding aggregation.

Figure 8:
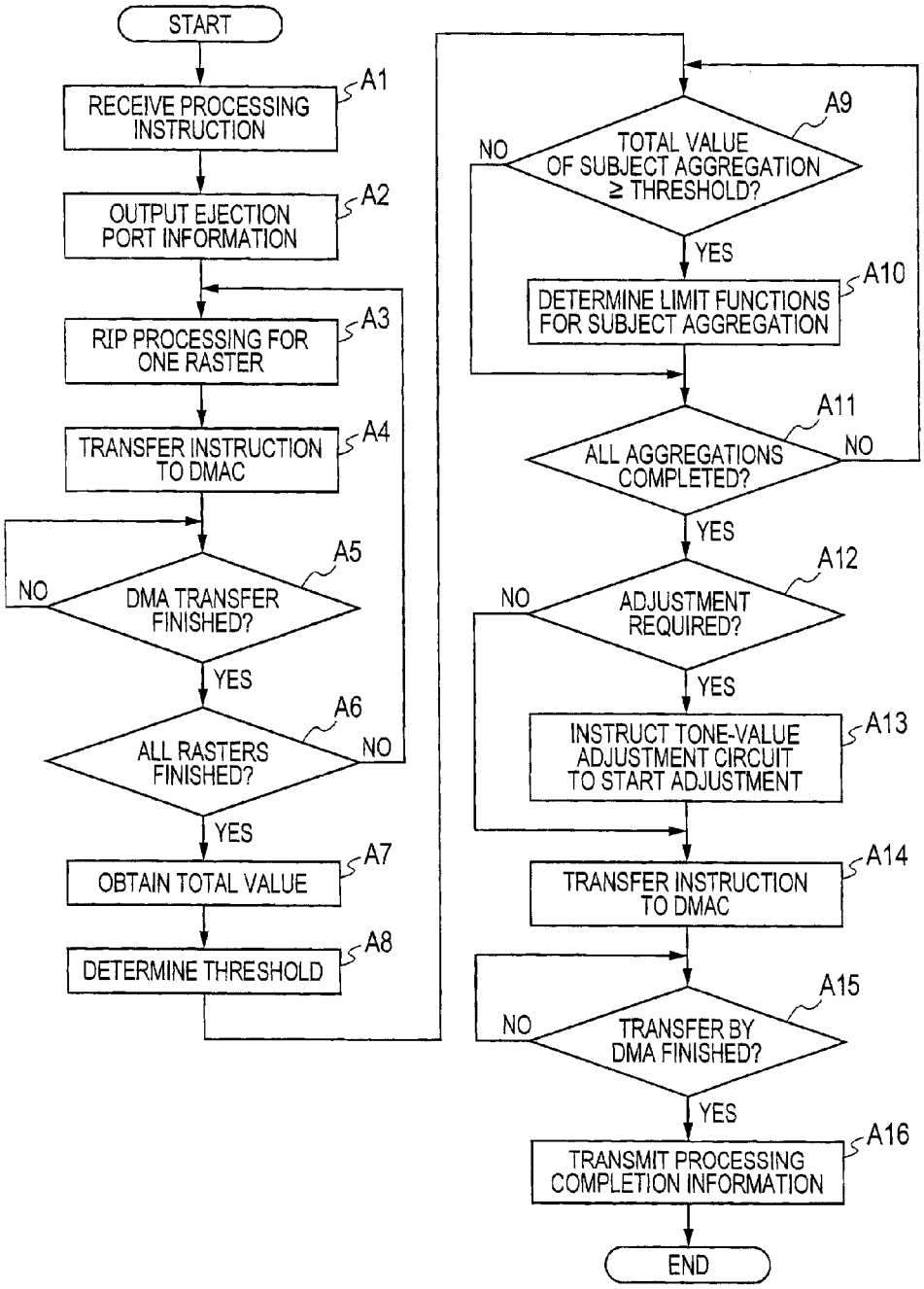
FIG. 8 is an explanatory diagram for illustrating operation of a sub CPU shown in FIG. 1.

Next, operation of the sub CPU 36 according to the present embodiment is described with reference to FIG. 8. Firstly, when a processing instruction is received from the main CPU 31 (A1), the sub CPU 36 determines properties of multi-valued image data created from print data stored in the print-data storage device 35 and based on the determination result, outputs one of a plurality of ejection-port information stored in the sub ROM 33 to the total-value calculation circuit 39 (A2). With this process, the ejection-port information is stored in the setting storage section 45 of the total-value calculation circuit 39.

Next, the sub CPU 36 applies RIP processing to a part of print data stored in the print-data storage device 35 in order to create a raster that is included in a plurality of rasters of multi-valued image data not created by RIP processing and is located at the most leading-end side of the paper (A3). Then, the sub CPU 36 instructs the DMA controller 38 to transfer data corresponding to the created one raster of the multi-valued image data (i.e. multi-valued image data converted into the CMYK color system by the color conversion circuit 42) to the image-data storage device 37 and the total-value calculation circuit 39 (A4). Next, the sub CPU 36 determines whether transfer-end information indicating the transfer process of step S4 is finished is received from the DMA controller 38 (A5). If it is determined that the transfer-end information is not received (A5: NO), the process of step A5 is repeated. In contrast, if reception of the transfer-end information is determined (A5: YES), the sub CPU 36 determines whether all the rasters of multi-valued image data have been created by RIP processing to print data that are stored in the print-data storage device 35 (A6). If it is determined that all the rasters of multi-valued image data are not created (A6: NO), the sub CPU 36 returns to step A3.

In contrast, if it is determined that all the rasters of multi-valued image data have been created (A6: YES), the sub CPU 36 obtains total tone values of respective aggregations stored in the corresponding memories 49 of the total-value storage section 48 from the total-value calculation circuit 39 (A7). Next, the sub CPU 36 determines (or adjusts) a threshold based on detection results of the ambient temperature of the recording heads 1 sent from the temperature sensors 26 and temperature-threshold-relation information stored in the threshold storage device 41 (A8). Thereafter, one of a plurality of aggregations of multi-valued image data stored in the image-data storage device 37 is set as a subject aggregation and it is determined whether a total tone value of the subject aggregation, which has been obtained from the total-value calculation circuit 39, is greater than or equal to the threshold determined in step A8 (A9). If the total tone value of the subject aggregation is determined to be less than the threshold (A9: NO), the sub CPU 36 moves to step A11. In contrast, if the total tone value of the subject aggregation is determined to be greater than or equal to the threshold (A9: YES), the subject aggregation is determined as an adjustment-requiring aggregation and, based on the difference between the total tone value and the threshold, the first limit function and the second limit function corresponding to the adjustment-requiring aggregation are determined (A10). Then, the sub CPU 36 moves to step A11.

In step A11, the sub CPU 36 determines whether all the aggregations of the multi-valued image data have been processed as the subject aggregation. If it is determined that all the aggregations of the multi-valued image data are not processed as the subject aggregation (A11: NO), the sub CPU 36 returns to step A9. In contrast, if it is determined that all the aggregations of the multi-valued image data have been processed as the subject aggregation (A11: YES), the sub CPU 36 determines whether a plurality of aggregations of the multi-valued image data includes an adjustment-requiring aggregation (A12). If no aggregation is determined as an adjustment-requiring aggregation (A12: NO), the sub CPU 36 moves to step A14.

In contrast, if there is an aggregation determined as an adjustment-requiring aggregation (A12: YES), the sub CPU 36 transmits the first limit function and the second limit function determined for each adjustment-requiring aggregation in step A10 to the tone-value adjustment circuit 40, and transmits an instruction to start adjustment to the tone-value adjustment circuit 40 so as to start the tone-value reducing process for reducing tone values of pixels belonging to the adjustment-requiring aggregation (A13). Therefore, in the multi-valued image data stored in the image-data storage device 37, pixels belonging to adjustment-requiring aggregations are replaced with pixels of which tone values have been reduced by the tone-value adjustment circuit 40. When this process in step A13 is finished, the sub CPU 36 moves to step A14.

In step A14, the sub CPU 36 instructs the DMA controller 38 to transfer multi-valued image data stored in the image-data storage device 37 to the drive-data generation circuit 55 of the liquid ejecting device 50. Next, the sub CPU 36 determines whether the transfer-end information, which indicates the transfer process of step A14 is finished, is received from the DMA controller 38 (A15). If the transfer-end information is not received (A15: NO), the sub CPU 36 repeats step A15. In contrast, if reception of the transfer-end information is determined (A15: YES), the sub CPU 36 outputs, to the main CPU 31, processing completion information which indicates that the transfer process of multi-valued image data to the drive-data generation circuit 55 is finished (A16). When the main CPU 31 receives the processing completion information, the main CPU 31 outputs a control signal to the recording circuit 73 and to the mechanism system driving control circuit 74. With this process, an image of drive data created by the drive-data generation circuit 55 is recorded on the paper P. The operation of the sub CPU 36 is as described above.

Figure 9:
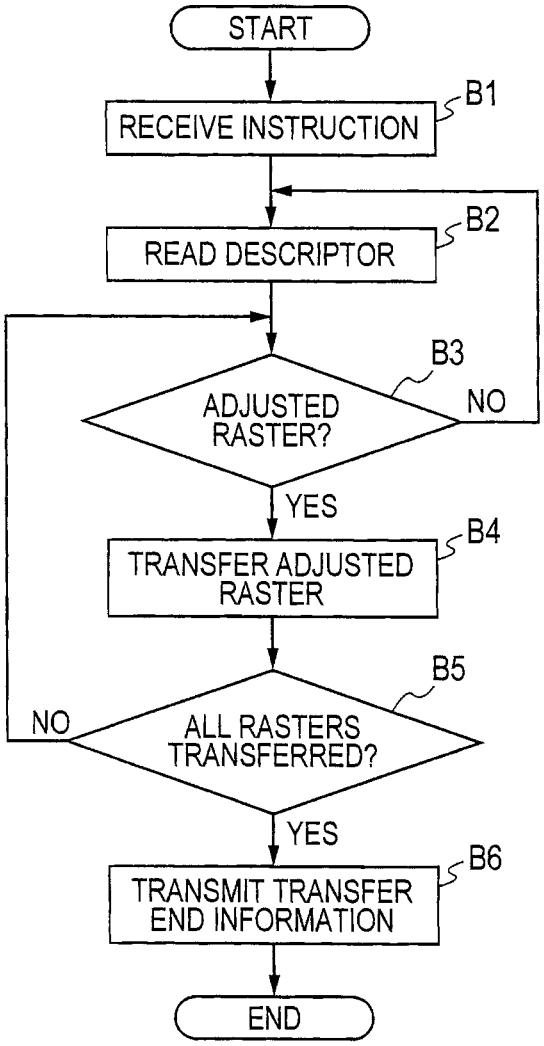
FIG. 9 is an explanatory diagram for illustrating a transfer process performed by a DMA controller shown in FIG. 1.

Next, the transfer process from the image-data storage device 37 to the drive-data generation circuit 55 by the DMA controller 38 is described with reference to FIG. 9. Firstly, when an output instruction is received from the sub CPU 36 (B1), the DMA controller 38 reads an output descriptor stored in the descriptor storage section 38*a* (B2) and determines whether a raster that is not transferred to the drive-data generation circuit 55 and is located at the most leading-end side of the paper in rasters of multi-valued image data stored in the image-data storage device 37 is an adjusted raster (B3). If the raster is not determined as an adjusted raster (B3: NO), the DMA controller 38 returns to step B2 on the assumption that pixels of which tone values are to be reduced by the tone-value adjustment circuit 40 are included in the raster.

In contrast, if the raster is determined as an adjusted raster (B3: YES), the DMA controller 38 transfers, to the drive-data generation circuit 55, the raster that is included in the rasters of the multi-valued image data stored in the image-data storage device 37 without being transferred to the drive-data generation circuit 55 and is located at the most leading-end side of the paper (B4). Thereafter, the DMA controller 38 determines whether all the rasters of the multi-valued image data stored in the image-data storage device 37 have been transferred to the drive-data generation circuit 55 (B5). If it is determined that all the rasters of the multi-valued image data are not transferred to the drive-data generation circuit 55 (B5: NO), the DMA controller 38 returns to step B3. In contrast, if it is determined that all the rasters of the multi-valued image data have been transferred to the drive-data generation circuit 55 (B5: YES), the transfer-end information is transmitted to the sub CPU 36 (B6) and the present process is finished.

As described above, according to the present embodiment, a total value of tone values of pixels belonging to one aggregation in multi-valued image data is made to be less than a threshold, whereby the amount of ink ejected from the ejection ports 108 during each aggregation ejection period can be restricted and, as a result, occurrence of an under-refilling phenomenon can be suppressed. Also, because tone values of multi-valued image data are reduced, tone values of unique pixels generated to reduce a quantization error are not reduced. Therefore, in comparison with the case of reducing tone values of drive data created by the drive-data generation circuit 55, quality deterioration of images recorded on the paper P can be suppressed.

Moreover, at least part of pixels of which tone values have been reduced by the tone-value adjustment circuit 40 is transmitted to the drive-data generation circuit 55 by the DMA controller 38 before the tone-value adjustment circuit 40 finishes the tone-value reducing process. Thus, transmission of multi-valued image data to the tone-value adjustment circuit 40 can be finished quickly. As a result, the drive-data generation circuit 55 can start creating drive data at earlier timing.

While the invention has been described in detail with reference to the above aspects thereof, it would be apparent to those skilled in the art that various changes and modifications may be made therein without departing from the scope of the claims.

For example, although the ejection ports 108 belonging to one actuator unit 21 are treated as one block in the aforementioned embodiment, each of ejection-port groups obtained by classifying the plurality of ejection ports 108 in the recording head 1 into ejection ports sharing a common liquid channel which is an ink supply source may be treated as one block. Or, each of a plurality of divided ejection-port groups obtained by dividing each of the ejection-port groups into plural groups may be treated as one block. Accordingly, for example, all the ejection ports 108 belonging to the recording head 1 may be treated as one block. Furthermore, each of divided ejection-port groups obtained by further dividing the plurality of ejection ports 108 belonging to one actuator unit 21 into plural groups may be treated as one block. Also, in a recording head having a plurality of independent head units with different liquid channels arranged in the main scanning direction X, an ejection-port group made of a plurality of ejection ports belonging to an actuator unit included in each head unit may be treated as one block. Moreover, each of divided ejection-port groups obtained by further dividing a plurality of ejection ports (or ejection-port groups) belonging to the actuator unit into plural groups may also be treated as one block.

Figure 10:
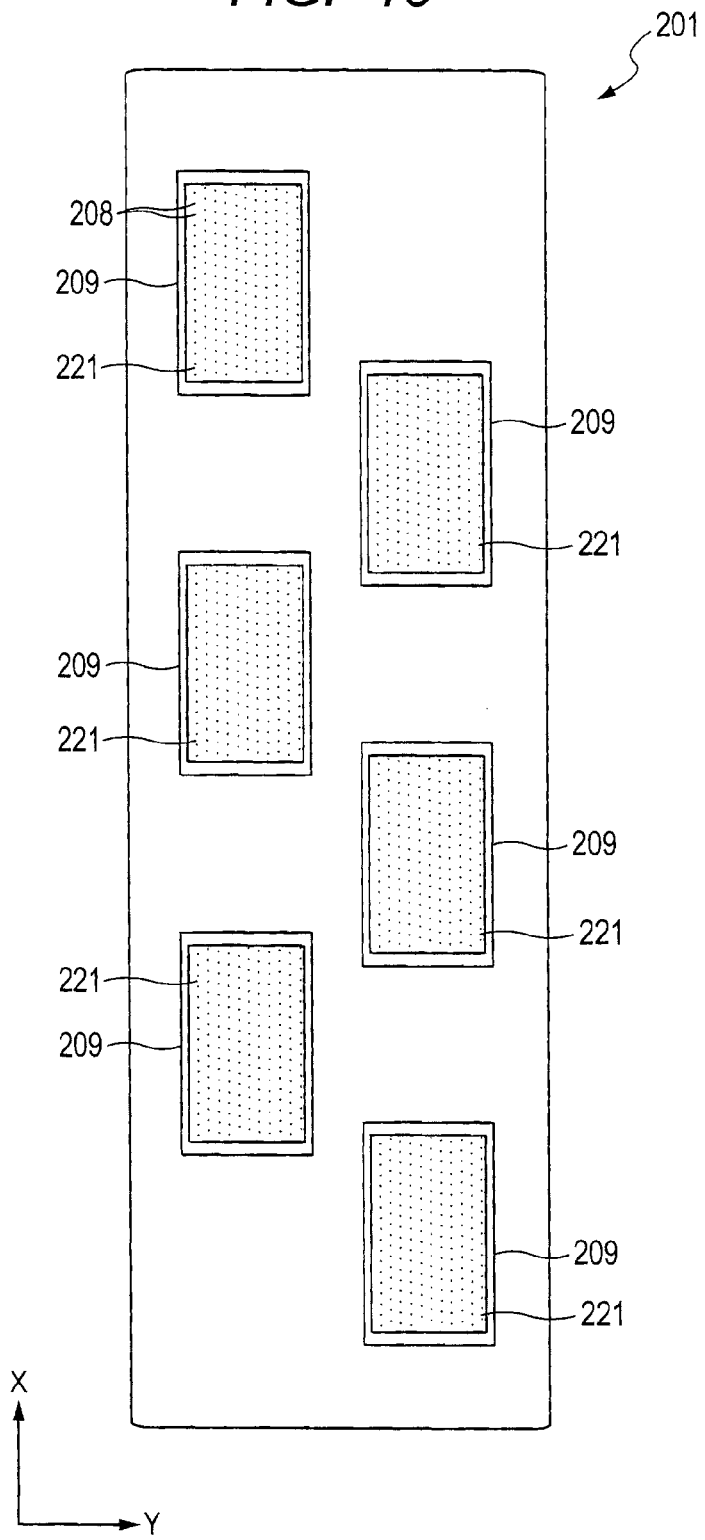
FIG. 10 is a plan view showing a recording head according to a modification.

For example, FIG. 10 shows a recording head having six independent head units arranged in the main scanning direction X. A recording head 201 includes six independent head units 209 each of which has a different liquid channel. Each of the head units 209 is provided with an actuator unit 221. In such a recording head 201, an ejection-port group made of a plurality of ejection ports 208 belonging to each of the actuator units 221 may be treated as one block. Each of divided ejection-port groups obtained by further dividing the plurality of ejection ports (or ejection-port groups) belonging to each actuator unit 221 into plural groups may also be treated as one block.

In the above-described embodiment, the DMA controller 38 transfers multi-valued image data from the image-data storage device 37 to the drive-data generation circuit 55 raster by raster. However, the transfer may be performed pixel by pixel.

The error diffusion processing carried out by the quantization circuit 62 in the above-described embodiment in order to reduce a quantization error may also be replaced with the dithering process. In the dithering process, a threshold in quantization is not fixed as a predetermined value but set for each pixel so as to reduce a quantization error statistically.

In the above-described embodiment, the inkjet printer 101 includes the image processing device 25. However, the external terminal 10 may include the image processing device 25. In this case, multi-valued image data adjusted by the tone-value adjustment circuit 40 are transferred from the external terminal 10 to the liquid ejecting device 50.

The invention is also applicable to image processing devices for transmitting multi-valued image data to liquid ejecting devices that eject liquid other than ink. The invention is also applicable to serial-type inkjet printers without being limited to line-type inkjet printers. However, when the invention is applied to a serial-type inkjet printer, an ejection cycle refers to a period of time required to move a serial head by a unit distance corresponding to a print resolution in the main scanning direction. The invention is also applicable to facsimile and copying apparatuses without being limited to printers. Processes performed by hardware such as the DMA controller 38, the total-value calculation circuit 39, the tone-value adjustment circuit 40, and the color conversion circuit 42 may be performed by a CPU that executes corresponding programs.

What is claimed is:

1. An image processing device configured to transmit input image data to a liquid ejecting device including a recording head and a drive data generator, the recording head having a plurality of ejection ports for ejecting liquid onto a recording medium and having at least one liquid channel for supplying liquid to respective ones of the plurality of ejection ports, the drive data generator being configured to quantize the input image data to an N-valued data (N is a natural number satisfying N≥2) with a quantization process including a process of reducing a quantization error to generate drive data of the recording head, the image processing device comprising:

a calculator configured to calculate a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium;

a tone-value reducer configured to reduce tone values of at least part of the pixels belonging to the aggregation of the pixels of the M-valued image data;

a transmitter configured to transmit the M-valued image data to the drive data generator of the liquid ejecting device, as the input image data; and a processor configured to perform:

controlling the calculator to calculate the total value of the tone values of all the pixels belonging to each of the plurality of aggregations;

controlling the tone-value reducer to, for an aggregation having the total value greater than or equal to a predetermined threshold, reduce the tone values of at least part of the pixels belonging to the aggregation so that the total value becomes less than the threshold, thereby adjusting the M-valued image data; and controlling the transmitter to transmit the M-valued image data to the drive data generator of the liquid ejecting device, as the input image data.

2. The image processing device according to claim 1, wherein the processor is configured to control the tone-value reducer to sequentially reduce the tone value of the pixel belonging to the aggregation of which the total value is greater than or equal to the threshold; and wherein the processor is configured to control the transmitter to transmit, to the drive data generator, at least part of the pixels of which the tone values are reduced, before the tone-value reducer finishes reducing the tone values for all the aggregations of which the total value is greater than or equal to the threshold.

3. The image processing device according to claim 1, wherein the processor is configured to control the tone-value reducer to reduce the tone values of the pixels belonging to the aggregation of which the total value is greater than or equal to the threshold in such a manner that the pixels closer to a boundary to an adjacent aggregation have smaller amounts of reduction in the tone values.

4. The image processing device according to claim 3, wherein the processor is configured to perform:

determining, for the aggregation having the total value greater than or equal to the threshold, a first limit function and a second limit function based on a difference between the total value and the threshold, the first limit function being indicative of a first variable determined according to a position of each pixel belonging to the aggregation in a conveying direction in which the recording medium is conveyed, the second limit function being indicative of a second variable determined according to a position of each pixel belonging to the aggregation in a perpendicular direction perpendicular to the conveying direction; and transmitting the first limit function and the second limit function to the tone-value reducer; and wherein the tone-value reducer is configured to perform:

obtaining, for each pixel belonging to the aggregation, a limit multiplier by multiplying the first variable by the second variable; and multiplying a tone value of each pixel belonging to the aggregation by the limit multiplier corresponding to the pixel, thereby obtaining an adjusted tone value.

5. The image processing device according to claim 1, wherein the processor is configured to set a smaller threshold as an ambient temperature of the recording head decreases.

6. The image processing device according to claim 1, wherein the liquid ejecting device further comprises a conveying mechanism configured to convey the recording medium;

wherein the recording head comprises a line-type head extending in a perpendicular direction that is perpendicular to a conveying direction in which the recording medium is conveyed by the conveying mechanism;

wherein the plurality of ejection ports is arranged in such a manner that a plurality of ejection-port arrays each arrayed in the perpendicular direction is arranged in the conveying direction, and that the plurality of ejection ports is in non-overlapping relationship with each other in the conveying direction; and wherein the calculator is configured to perform:

allocating pixels of the M-valued image data to the plurality of ejection ports; and calculating the total value of all the pixels belonging to each of the plurality of aggregations that is an aggregation of pixels allocated to the ejection ports belonging to the one of the plurality of blocks, the pixels corresponding to dots to be formed on the recording medium when liquid is ejected from the ejection ports during one of the L ejection periods.

7. The image processing device according to claim 1, wherein the process of reducing a quantization error is one of an error diffusion process and a dithering process.

8. A storage medium storing a set of instructions executable on an image processing device configured to transmit input image data to a liquid ejecting device including a recording head and a drive data generator, the recording head having a plurality of ejection ports for ejecting liquid onto a recording medium and having at least one liquid channel for supplying liquid to respective ones of the plurality of ejection ports, the drive data generator being configured to quantize the input image data to an N-valued data (N is a natural number satisfying N≥2) with a quantization process including a process of reducing a quantization error to generate drive data of the recording head, the set of instructions comprising:

calculating a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium;

performing, for an aggregation having the total value greater than or equal to a predetermined threshold, a tone-value reducing process of reducing tone values of at least part of the pixels belonging to the aggregation so that the total value becomes less than the threshold, thereby adjusting the M-valued image data; and transmitting the M-valued image data to the drive data generator of the liquid ejecting device, as the input image data.

9. A recording apparatus comprising:

a liquid ejecting device comprising:

a recording head having a plurality of ejection ports for ejecting liquid onto a recording medium and having at least one liquid channel for supplying liquid to respective ones of the plurality of ejection ports; and a drive data generator configured to quantize the input image data to an N-valued data (N is a natural number satisfying N≥2) with a quantization process including a process of reducing a quantization error to generate drive data of the recording head; and an image processing device comprising:

a calculator configured to calculate a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium;

a tone-value reducer configured to reduce tone values of at least part of the pixels belonging to the aggregation of the pixels of the M-valued image data;

a transmitter configured to transmit the M-valued image data to the drive data generator of the liquid ejecting device, as the input image data; and a processor configured to perform:

controlling the calculator to calculate the total value of the tone values of all the pixels belonging to each of the plurality of aggregations;

controlling the tone-value reducer to, for an aggregation having the total value greater than or equal to a predetermined threshold, reduce the tone values of at least part of the pixels belonging to the aggregation so that the total value becomes less than the threshold, thereby adjusting the M-valued image data; and controlling the transmitter to transmit the M-valued image data to the drive data generator of the liquid ejecting device, as the input image data.

10. The recording apparatus according to claim 9, wherein the liquid ejecting device further comprises a conveying mechanism configured to convey the recording medium;

wherein the recording head comprises a line-type head extending in a perpendicular direction that is perpendicular to a conveying direction in which the recording medium is conveyed by the conveying mechanism;

wherein the plurality of ejection ports is arranged in such a manner that a plurality of ejection-port arrays each arrayed in the perpendicular direction is arranged in the conveying direction, and that the plurality of ejection ports is in non-overlapping relationship with each other in the conveying direction; and wherein the calculator is configured to perform:

allocating pixels of the M-valued image data to the plurality of ejection ports; and calculating the total value of all the pixels belonging to each of the plurality of aggregations that is an aggregation of pixels allocated to the ejection ports belonging to the one of the plurality of blocks, the pixels corresponding to dots to be formed on the recording medium when liquid is ejected from the ejection ports during one of the L ejection periods.

11. The recording apparatus according to claim 9, wherein the recording head comprises a plurality of actuator units each including a plurality of actuators opposing pressure chambers in communication with respective ones of the plurality of ejection ports; and wherein the plurality of ejection ports corresponding to one of the plurality of actuator units constitutes one of the plurality of blocks.

12. An image processing device configured to transmit input image data to a liquid ejecting device including a recording head and a drive data generator, the recording head having a plurality of ejection ports for ejecting liquid onto a recording medium and having at least one liquid channel for supplying liquid to respective ones of the plurality of ejection ports, the drive data generator being configured to quantize the input image data to an N-valued data (N is a natural number satisfying N≥2) with a quantization process including a process of reducing a quantization error to generate drive data of the recording head, the image processing device comprising a controller configured to:

calculate a total value of tone values of all pixels belonging to each of a plurality of aggregations by allocating each pixel of M-valued image data (M is a natural number satisfying M>N) to one of the plurality of aggregations, each of a plurality of blocks being defined as either one of ejection-port groups including the plurality of ejection ports having a common liquid channel serving as a liquid supply source or one of a plurality of divided ejection-port groups that is obtained by dividing each of the ejection-port groups, each of the plurality of aggregations being defined as an aggregation of pixels of the M-valued image data corresponding to dots that are formed on the recording medium when liquid is ejected from the ejection ports belonging to one of the plurality of blocks during one of L ejection periods (L is a natural number satisfying L≥1), each of the L ejection periods corresponding to a number of divided ejection cycles that is obtained by dividing, by a plural number, a number of ejection cycles of the recording head required to record an image of the M-valued image data on one recording medium;

perform, for an aggregation having the total value greater than or equal to a predetermined threshold, a tone-value reducing process of reducing tone values of at least part of the pixels belonging to the aggregation so that the total value becomes less than the threshold, thereby adjusting the M-valued image data; and transmit the M-valued image data to the drive data generator of the liquid ejecting device, as the input image data.

* * * * *